US005199585A

United States Patent [19]

Schäfer

[11] Patent Number: 5,199,585

[45] Date of Patent: Apr. 6, 1993

[54] SUPPORT ARRANGEMENT FOR COMPONENTS IN SHELF SYSTEMS

[75] Inventor: Gerhard Schäfer, Neunkirchen/Salchendor, Fed. Rep. of Germany

[73] Assignee: Fritz Schafer Gesellschaft mit beschrankter Haftung, Neunkirchen, Fed. Rep. of Germany

[21] Appl. No.: 694,426

[22] Filed: May 1, 1991

[30] Foreign Application Priority Data

May 1, 1990 [DE] Fed. Rep. of Germany ..... 4013989

[51] Int. Cl.[5] ..... A47F 5/00

[52] U.S. Cl. ..... 211/187; 211/208; 108/107; 248/243

[58] Field of Search ..... 211/187, 186, 208; 108/107, 144; 248/243

[56] References Cited

U.S. PATENT DOCUMENTS

| | | | |
|---|---|---|---|
| 2,760,650 | 8/1956 | Franks | 108/144 |
| 3,900,112 | 8/1975 | Azzi et al. | 211/151 X |
| 4,405,052 | 9/1983 | Spiros | 211/187 X |
| 4,421,239 | 12/1983 | Vargo | 211/187 |
| 4,453,641 | 6/1984 | Rasmussen et al. | 211/187 X |
| 4,515,494 | 5/1985 | Robilliard et al. | 211/187 X |
| 4,828,120 | 5/1989 | Beil et al. | 211/88 |

FOREIGN PATENT DOCUMENTS

| | | |
|---|---|---|
| 0037277 | 10/1981 | European Pat. Off. . |
| 1528633 | 5/1968 | France . |
| 2260312 | 9/1975 | France . |
| 856482 | 12/1960 | United Kingdom . |
| 2097087 | 10/1982 | United Kingdom . |

*Primary Examiner*—Robert W. Gibson, Jr.
*Attorney, Agent, or Firm*—Anderson Kill Olick & Oshinsky

[57] ABSTRACT

A support arrangement for components in shelf systems, particularly for continuous frames in continuous shelf systems. The arrangement includes hanging brackets each of which is provided on the rear side thereof with a group of locking hooks. The arrangement further includes shelf posts with openings for releasably receiving the locking hooks of the hanging brackets. Each hanging bracket has on the rear side thereof near opposite ends of the bracket a support edge each for the components. All locking hooks are constructed as approximately T-shaped double hooks, so that each of the support edges can be placed relative to the shelf posts in an upwardly directed position. The group of double hooks is located on the hanging brackets in such a way that they are asymmetrically offset relative to the two support edges.

21 Claims, 3 Drawing Sheets

SUPPORT ARRANGEMENT FOR COMPONENTS IN SHELF SYSTEMS

BACKGROUND OF THE INVENTION

1. Field of the Invention

The present invention relates to a support arrangement for components in shelf systems, particularly for continuous frames in continuous shelf systems. The arrangement includes hanging brackets each of which is provided on the rear side thereof with a group of locking hooks. The arrangement further includes shelf posts with openings for releasably receiving the locking hooks of the hanging brackets. Each hanging bracket has on the rear side thereof near the opposite ends of the bracket a support edge each for the components. All locking hooks are constructed as approximately T-shaped double hooks, so that each of the support edges can optionally be placed relative to the shelf post in an upwardly directed position.

2. Description of the Related Art

A support arrangement of the above-described type is known, for example, from EP-Al-0 037 277. In this arrangement, each hanging bracket consists of a structural component which is approximately U-shaped in cross-section and which is in its totality constructed symmetrically relative to a transverse median plane, although at the rear side on one of the legs of the U-shaped component is provided only one approximately T-shaped double hook, while the other leg of the U-shaped component is provided with approximately two T-shaped double hooks. The hanging brackets have the above-described configuration because the shelf posts are provided with two parallel rows of opening which rows are located offset relative to each other in longitudinal direction by half the spacing between two openings, wherein each hanging bracket is placed in releasable engagement by simultaneously inserting all double hooks in the openings.

Support edges for the components are provided on the rear side of each hanging bracket at the legs thereof on both sides of the plane of symmetry. The support edges have the same distance from the transverse plane of symmetry, so that turning of the hanging bracket by 180° in its plane of operation relative to the shelf posts makes it possible to carry out vertical displacement of the hanging brackets on the shelf posts when the effective height of the support edge differs only by half a spacing of the openings.

However, this known support arrangement has the disadvantage that the hanging brackets require a relatively large amount of material because of the U-shaped cross-section thereof and, therefore, are relatively expensive to produce.

SUMMARY OF THE INVENTION

Therefore, it is the object of the present invention to further develop a support arrangement of the above-described type, so that a vertically offset assembled position of the support edges for the components provided on the hanging brackets can be achieved by making it possible to lock the hanging bracket relative to the same openings in the shelf posts by means of the approximately T-shaped double hook in two positions which are turned by 180° relative to each other.

In accordance with the present invention, the above object is met by providing the group of double hooks on the hanging brackets in such a way that they are asymmetrically offset relative to the two support edges.

Thus, the vertical displacement of the support edge on the hanging bracket advantageously can be determined by the extent of the asymmetry, without having to place the hanging bracket in other openings of the shelf posts.

In accordance with another advantageous feature, the ratio of the distances of the two support edges of the hanging brackets from the plane of symmetry of the group of double hooks is approximately 1:1.33 to 1:1.5, so that the extent of the possible vertical displacement is not only dependent on the spacing between successive openings in the shelf posts.

It has also been found useful if the spacing between two openings in the shelf posts correspond to half the spacing between two double hooks of the group of double hooks in the hanging brackets, so that the number of possible variations of the vertical position of the support edges of the hanging brackets can be increased in a particularly simple manner.

If, in accordance with the present invention, two groups of openings are provided in two parallel rows in the shelf posts and the openings of the two rows are offset relative to each other in longitudinal direction, the number of possible horizontally displaced positions of the support edges of the hanging brackets can again be doubled.

The longitudinal displacement between the openings of the two rows of openings can be provided in such a way that it only corresponds to a fraction of the spacing between two openings located in the same row. Preferably, this offset position should not correspond to half the spacing, but rather to a smaller fraction thereof, for example, a fourth of the spacing between the openings.

In accordance with another advantageous further development of the support arrangement, a transverse connection is provided between two adjacent openings in the two parallel rows of openings, so that the adjacent openings open into each other.

In accordance with the present invention, always two adjacent openings together with the transverse connection thereof may have an approximately r-shaped circumferential configuration, wherein the long r-leg is adapted in its dimension to the cross-sectional dimension of a double hook in the region of a head member thereof. The transverse connection has a passage height which exceeds the cross-sectional height of a double hook in the region of the shaft thereof, and the short r-leg, in turn, has a dimension which is smaller than the cross-sectional height of a double hook in the region of the head member thereof, but greater than the dimension in the region of the shaft of the double hook.

The configuration according to the present invention has the advantage that the individual hanging brackets can be moved between two different vertical positions after having been coupled to the openings of the shelf posts, without requiring a complete removal of the hanging bracket from the openings in which the hanging bracket is mounted.

In accordance with a useful feature of the invention, each group of double hooks of a hanging bracket has only two double hooks.

In the simplest case, the hanging brackets can be manufactured from a plane blank of sheet metal. However, for increasing the stability of the hanging bracket, the hanging bracket may be bent in the distance portion between the two double hooks into a zigzag shape transversely relative to the plane of the bracket, wherein the bent shape leads to an increased support width on the shelf post.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

BRIEF DESCRIPTION OF THE DRAWING

In the drawing:

FIGS. 8*b* to 8*e* are longitudinal sectional views of the shelf posts showing four different assembly positions of the hanging brackets of FIGS. 4 to 7.

DESCRIPTION OF THE PREFERRED EMBODIMENTS

Figure 1:
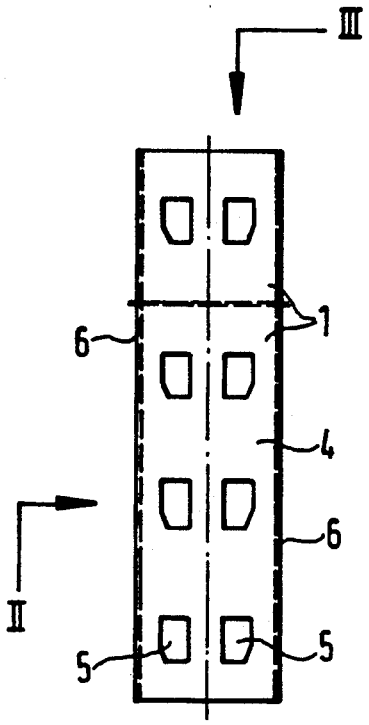
FIG. 1 is a front view of a shelf post of the support arrangement according to the present invention.
Figure 2:
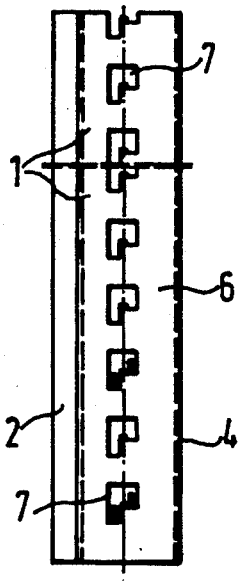
FIG. 2 is a side view of the shelf post of FIG. 1.
Figure 3:
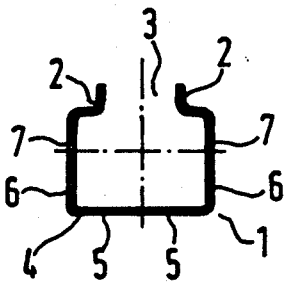
FIG. 3 is a cross-sectional view of the shelf post of FIG. 1.

FIGS. 1 to 3 of the drawing show a shelf post 1 constructed, for example, as a steel section. The shelf post 1 has at one longitudinal side thereof a longitudinal slot 3 which is bordered by, for example, outwardly directed end flanges 2.

The wall 4 of the shelf post 1 facing away from the longitudinal slot 3 is provided with two parallel rows of openings 5 which are visable in FIGS. 1 and 3 of the drawing.

Each of the two other walls 6 of the shelf post 1 has a row of opening 7. The arrangement and shape of the openings 7 can be seen in FIGS. 2 and 3 of the drawing.

FIG. 2 of the drawing, and on a larger scale the left-hand outer illustration of FIG. 8, show that each individual opening 7 has an approximately r-shaped circumferential configuration.

Thus, as can be seen in particularly in FIG. 8, each individual opening 7 has essentially a left, long vertically extending r-leg 8, a right, short vertically extending r-leg 9 and an upper transverse connection 10 between the two r-legs 8 and 9.

The r-leg 8 has a width 11, the r-leg 9 has a width 12, wherein the widths 11 and 12 are spaced apart from each other by a distance 13 which constitutes the width of the transverse connection 10.

The r-leg 8 has a cross-sectional height 14, while the r-leg 9 has a smaller cross-sectional height 15. The passage height 16 of the transverse connection 10 between the two r-legs 8 and 9, in turn, is smaller than the cross-sectional height 15 of the r-leg 9, so that an upwardly directed nose 17 remains between the r-leg 9 and the r-leg 8.

Figure 5:
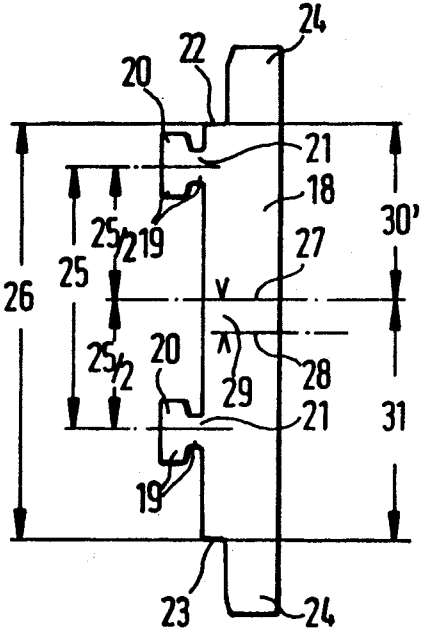
FIG. 5 is a side view of the hanging bracket of FIG. 4.
Figure 4:
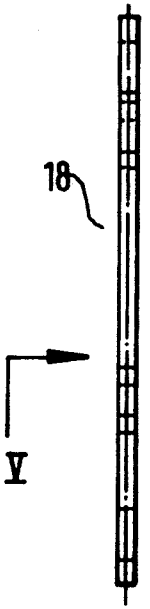
FIG. 4 is a rear view of a particularly simple hanging bracket of the support arrangement according to the present invention.
Figure 8E:
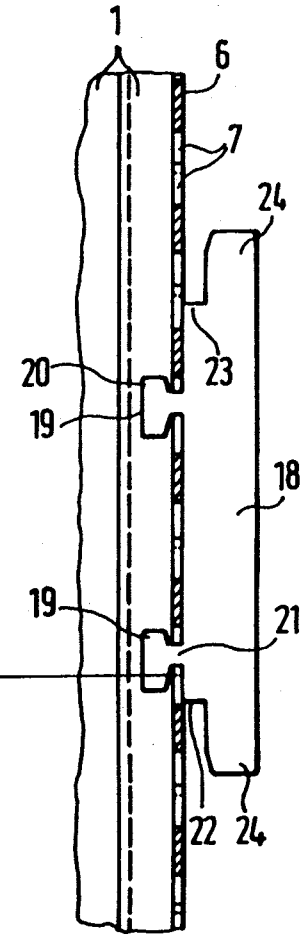
Figure 8D:
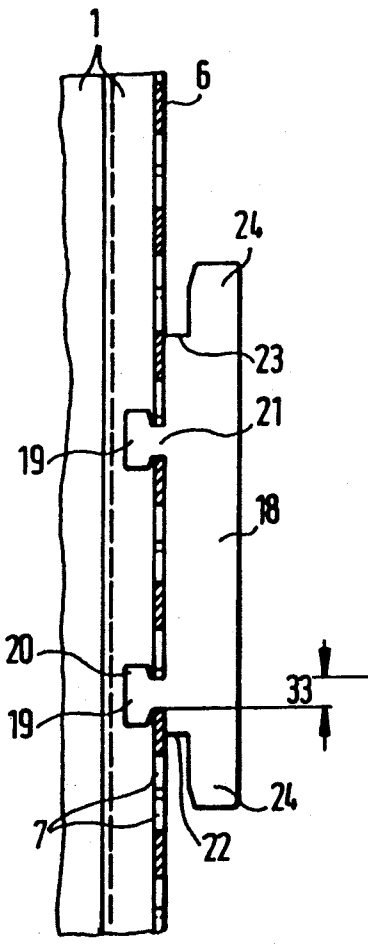
Figure 6C:
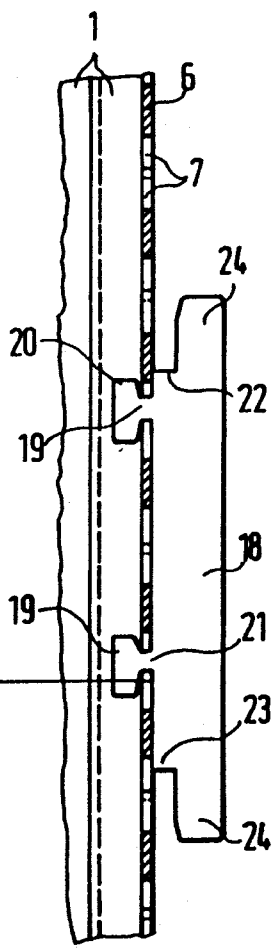
Figure 8B:
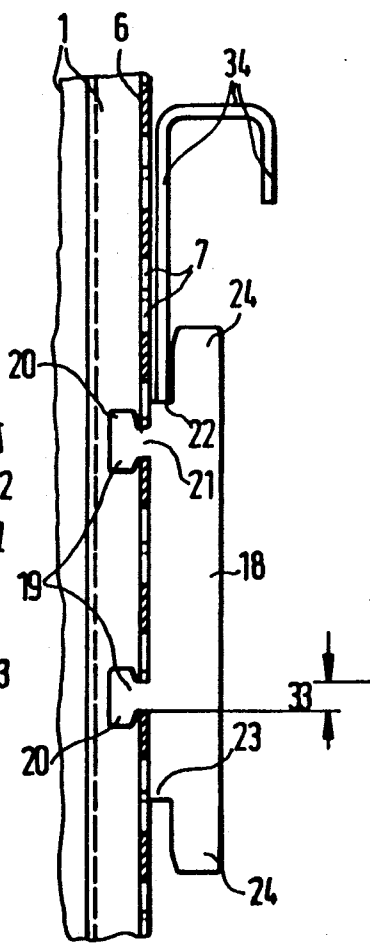
Figure 8A:
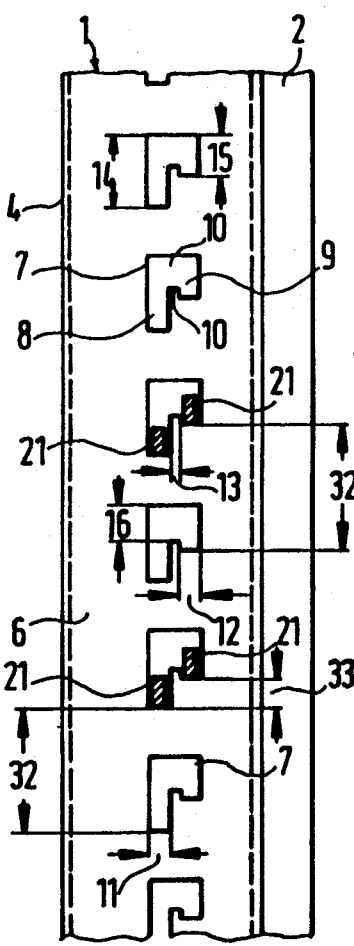
FIG. 8*a* shows, on a larger scale, a shelf post according to FIG. 2 in a side view.

Another important structural component of the support arrangement for components in shelf systems are hanging brackets 18, the simplest embodiment of which is shown in FIGS. 4 and 5 of the drawing. It is apparent that the hanging brackets 18 may consist of a plane blank of sheet metal which at the rear sides thereof has a group of double hooks 19, for example, two double hooks. Each of the double hooks has an approximately T-shaped circumferential configuration. The T-shape is determined by a head member 20 and a shaft 21, as can be clearly seen in FIG. 5.

In addition, each hanging bracket 18 has on the rear side thereof two support edges 22 and 23 which can be used as support surfaces for the components to be installed in the shelf system. A finger-like projection 24 or 25 projects upwardly or downwardly beyond each support edge 22 or 23, respectively.

The important structural feature of the hanging brackets 18 is the fact that the group of double hooks is arranged asymmetrically offset relative to the two support edges 22 and 23, as can be clearly seen in FIG. 5 of the drawing.

The two double hooks 19 of the group of double hooks have a spacing 25 from each other which is substantially smaller than the spacing 26 between the two support edges 22 and 23.

The plane of symmetry of the group of double hooks 19 is located on line 27, while the plane of symmetry between the two support edges 22 and 23 coincides with line 28. The distance between the two lines 27 and 28 determines the asymmetry which exists between the group of double hooks 19 and the two support edges 22 and 23.

In a preferred configuration of the hanging brackets 18, the ratio of the distances 30 and 31 of the two support edges 22 and 23 from the plane of symmetry 27 of the group of double hooks is, for example, 1:1.5.

In accordance with another advantageous feature, the spacing 32 between two successive openings 7 in the shelf post 1 is dimensioned in such a way that it corresponds to half a spacing 25 between the two double hooks 19 of the group of double hooks in the brackets 18.

The r-shaped circumferential configuration of the individual openings 7 makes it possible that the openings 7 can be effective practically as two groups of openings which are arranged in rows which are parallel to each other and which are offset in longitudinal direction.

One of these rows of openings is determined by the long r-leg 8 and the other row of openings is determined by the short r-leg 9 of each opening 7.

The width 11 and the cross-sectional height 14 of the long r-leg 8 are slightly greater than the cross-sectional shape of the head member 20 of a double hook 19 of the hanging brackets 18. The width 12 of the short r-leg 9 is also greater than the cross-sectional thickness of a double hook 19 in the region of its head member 20 and its shaft 21. While the cross-sectional height 15 of the short r-leg 9 is smaller than the cross-sectional height of a double hook 19 in the region of its head member 20, it is greater than the cross-sectional height of such a double hook 19 in the region of its shaft 21.

Finally, the passage height 16 of the transverse connection in the opening 7 is slightly greater than the cross-sectional height of a double hook 19 in the region of its shaft 21.

The double hooks 19 of the hanging brackets 18 are always inserted in the opening 7 of the shelf posts 1 in the region of the long r-shaped leg 8 because only this long r-leg 8 provides sufficient space for passing the head members 20 of the double hooks 19 therethrough. However, the hanging brackets 18 can be hooked into the shelf post 1 optionally either in the region of the long r-leg 8 or in the region of the short r-leg 9, as can be seen in the illustration in FIG. 1 on the left-hand side thereof. Thus, the hanging brackets 18 can be anchored in the shelf posts 1 by means of the double hooks 19 in two different vertical positions without having to change the opening 7 being used. As shown in FIG. 8*a* to 8*e* of the drawing, a vertical difference 33 exists between the two possible hanging positions of the hanging brackets 18 in one and the same opening 7.

Thus, while the hanging brackets 18 remain mounted in the same opening, they can be placed with their upwardly facing support edge 22 in two different vertical positions relative the shelf post 1. By turning the mounted position of the hanging bracket 18 by 180°, the support edge 23 is placed in operating position instead of the support edge 22, so that two additional adjustments for the vertical position of the support edges 23 are possible, as can be seen clearly in FIG. 8 of the drawings. As clearly visible from the four longitudinal sectional views of FIG. 8, it is possible to adjust four different mounted positions of each hanging bracket 18 over the spacing 32 between two successive openings 7, so that the vertical position of the support edges 22 and 23 can be varied with relatively fine increments. Accordingly, the vertical positions of the components 34 can also be varied with relatively fine increments relative to the shelf posts 1.

Figure 7:
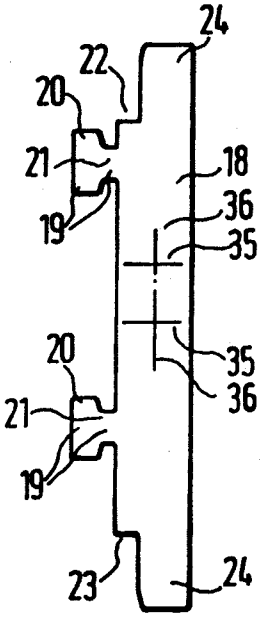
FIG. 7 is a side view of the hanging bracket of FIG. 6.
Figure 6:
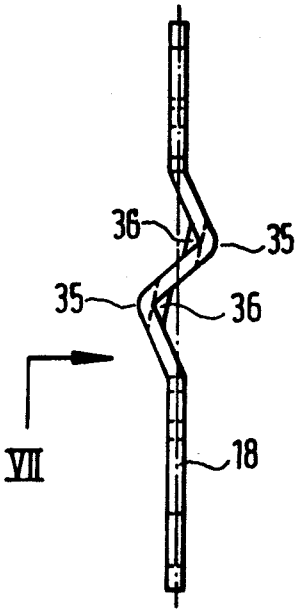
FIG. 6 is a rear view of a further development of a hanging bracket for the support arrangement according to the present invention.

While it is in most cases sufficient to use as the support for the components 34 on the shelf posts 1 hanging brackets 18 which are made from a plane stamped part of sheet metal, as it is shown in FIGS. 4 and 5, it may be advantageous particularly for reasons of stability to use hanging brackets 18 of the type illustrated in FIGS. 6 and 7. The hanging bracket 18 shown in FIGS. 6 and 7 of the drawing has in the portion between the two double hooks 19 zigzag-shaped bent portions 35 extending transversely of the plane of the hanging bracket. Each of the bent portions 35, in turn, is stabilized by an integrally formed stiffening corrugation 36.

The bent portions 35 substantially increase in a simple manner the contact area between the hanging bracket 18 and the wall 6 of the shelf post 1 and, thus, prevent undesirable tilting of the mounted position of the hanging bracket relative to the shelf post 1.

Since the openings 7 which are approximately r-shaped in their circumferential configuration are uniformly distributed over the entire length of the shelf post 1, it is possible to couple the hanging brackets 18 over the entire length of the posts by means of the double hooks 19 with vertical positions which are variable with fine increments and to place the support edges 22 and 23 into effective positions whose number is increased threefold relative to the number of openings 7. Thus, if the spacing 32 between two successive openings 7 is 250 mm and the vertical difference 33 between the lower end of the long r-leg 8 and the lower end of the short r-leg 9 of each opening 7 is 62.5 mm, the asymmetrically offset positions of the support edges 22 and 23 relative to the double hooks 19 of the hanging brackets 18 make it possible to mount the hanging brackets 18 in four different positions along the spacing 32, wherein the four positions are each spaced from each other by 61.5 mm.

While specific embodiments of the invention have been shown and described in detail to illustrate the inventive principles, it will be understood that the invention may be embodied otherwise without departing from such principles.

I claim:

1. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with said at least one row of openings in said for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in said at least one row of openings in said the shelf post corresponding to half a spacing between two double hooks of the groups of double hooks of the hanging brackets.

2. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in the shelf post corresponding to half a spacing between the two double hooks of the group of double hooks of the hanging brackets, wherein the double hooks on the hanging brackets are located asymmetrically offset relative to the two support edges, and wherein the two support edges of the hanging brackets are each located at a distance from a plane of symmetry of the group of double hooks, and wherein a ratio of the distances of the two support edges from the plane of symmetry is between 1:1.33 and 1:1.5.

3. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in the shelf post corresponding to half a spacing between two double hooks of the group of double hooks of the hanging brackets, and wherein two groups of openings are provided in the shelf posts, the two groups of openings being arranged in rows extending parallel to each other.

4. The support arrangement according to claim 3, wherein the openings of the two rows of openings in the shelf posts are longitudinally offset relative to each other by a vertical difference.

5. The support arrangement according to claim 4, wherein the vertical difference between the openings of the two rows of openings corresponds to a fraction of the spacing between two of the openings located in the same row.

6. The support arrangement according to claim 5, wherein a ratio between the spacing between two openings in the same row and the vertical difference is approximately 4:1.

7. The supporting arrangement according to claim 6, wherein a transverse connection is provided between two adjacent openings of the two parallel rows of openings.

8. The support arrangement according to claim 7, wherein two adjacent openings have together with the corresponding transverse connection an approximately r-shaped circumferential configuration with a long r-leg being formed by one of the openings and a short r-leg being formed by the other of the openings, each T-shaped double hook having a head member and a shaft connected to the head member, wherein the long r-leg is adapted in its dimension to a cross-sectional dimension of the head member of the double hook, the transverse connection having a passage height which exceeds a cross-sectional height of the shaft of the double hook, and wherein the short r-leg has a dimension which is smaller than the cross-sectional height of the head member of the double hook but greater than the cross-sectional height of the shaft of the double hook.

9. The support arrangement according to claim 8, wherein each group of double hooks of a hanging bracket is composed of two double hooks.

10. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with at least one row of openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in said at least one row of openings in said shelf post corresponding to half a spacing between the two double hooks of the group of double hooks of the hanging brackets, and wherein the hanging brackets are stamped parts of sheet metal.

11. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in the shelf post corresponding to half a spacing between two double hooks of the group of double hooks of the hanging brackets, and wherein wherein the hanging brackets have in a portion between two double hooks zigzag-shaped bent portions extending transversely of a plane of the hanging brackets, and stiffening corrugations for stabilizing the bend portions.

12. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising a spacing between two successive openings in the shelf post corresponding to half a spacing between the two double hooks of the group of double hooks of the hanging brackets, wherein the double hooks on the hanging brackets are located asymmetrically offset relative to the two support edges.

13. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising the double hooks on the hanging brackets being located asymmetrically offset relative to the two support edges, wherein the two support edges of the hanging brackets are each located at a distance from a plane of symmetry of the group of double hooks, and wherein a ratio of the distances of the two support edges from the plane of symmetry is between 1:1.33 and 1:1.5, and further wherein a spacing between two successive openings in the shelf post corresponds to half a spacing between two double hooks of the group of double hooks of the hanging brackets.

14. The support arrangement according to claim 13, wherein two groups of openings are provided in the shelf posts, the two groups of openings being arranged in rows extending parallel to each other.

15. The support arrangement according to claim 14, wherein the openings of the two rows of openings in the shelf posts are longitudinally offset relative to each other by a vertical difference.

16. The support arrangement according to claim 15, wherein the vertical difference between the openings of the two rows of openings corresponds to a fraction of the spacing between two of the openings located in the same row.

17. The support arrangement according to claim 16, wherein a ratio between the spacing between two openings in the same row and the vertical difference is approximately 4:1.

18. The support arrangement according to claim 17, wherein a transverse connection is provided between two adjacent openings of the two parallel rows of openings.

19. The support arrangement according to claim 18, wherein two adjacent openings have together with the corresponding transverse connection an approximately r-shaped circumferential configuration with a long r-leg being formed by one of the openings and a short r-leg being formed by the other of the openings, each T-shaped double hook having a head member and a shaft connected to the head member, wherein the long r-leg is adapted in its dimension to a cross-sectional dimension of the head member of the double hook, the transverse connection having a passage height which exceeds a cross-sectional height of the shaft of the double hook, and wherein the short r-leg has a dimension which is smaller than the cross-sectional height of the head member of the double hook but greater than the cross-sectional height of the shaft of the double hook.

20. The support arrangement according to claim 19, wherein each group of double hooks of a hanging bracket is composed of two double hooks.

21. In a support arrangement for components in shelf systems, particularly for continuous frames in continuous shelf systems, the arrangement including hanging brackets, each hanging bracket being provided on a rear side thereof with a group of locking hooks, the arrangement further including shelf posts with openings for releasably receiving the locking hooks of the hanging brackets, each hanging bracket having on the rear side thereof near opposite ends of the bracket a support edge each for support of the components, the locking hooks being approximately T-shaped double hooks, such that each of the support edges can be placed relative to the shelf post in an upwardly directed position, the improvement comprising the double hooks on the hanging brackets being located asymmetrically offset relative to the two support edges, and wherein the hanging brackets have in a portion between two double hooks zigzag-shaped bent portions extending transversely of a plane of the hanging brackets, and stiffening corrugations for stabilizing the bent portions.

* * * * *